US007976316B2

(12) United States Patent
Ohshida

(10) Patent No.: US 7,976,316 B2
(45) Date of Patent: Jul. 12, 2011

(54) ELECTRICAL CONNECTOR

(75) Inventor: Tadashi Ohshida, Tokyo (JP)

(73) Assignee: Hirose Electric Co., Ltd., Tokyo (JP)

( * ) Notice: Subject to any disclaimer, the term of this patent is extended or adjusted under 35 U.S.C. 154(b) by 30 days.

(21) Appl. No.: 12/556,722

(22) Filed: Sep. 10, 2009

(65) Prior Publication Data

US 2010/0075538 A1 Mar. 25, 2010

(30) Foreign Application Priority Data

Sep. 22, 2008 (JP) ..... 2008-242879

(51) Int. Cl.
*H01R 12/00* (2006.01)

(52) U.S. Cl. ..... 439/74; 439/607.39; 439/607.55

(58) Field of Classification Search ..... 439/74, 439/607.35, 607.39, 607.55
See application file for complete search history.

(56) References Cited

U.S. PATENT DOCUMENTS

| | | | | |
|---|---|---|---|---|
| 5,057,028 | A * | 10/1991 | Lemke et al. | 439/101 |
| 5,536,179 | A * | 7/1996 | Olsson et al. | 439/108 |
| 5,577,936 | A * | 11/1996 | Hahn | 439/607.28 |
| 6,231,355 | B1 * | 5/2001 | Trammel et al. | 439/79 |
| 6,296,496 | B1 * | 10/2001 | Trammel | 439/79 |
| 6,338,635 | B1 * | 1/2002 | Lee | 439/108 |
| 6,447,310 | B1 * | 9/2002 | Brown | 439/108 |
| 6,638,081 | B2 * | 10/2003 | Korsunsky et al. | 439/79 |
| 6,648,657 | B1 * | 11/2003 | Korsunsky et al. | 439/108 |
| 6,685,485 | B2 * | 2/2004 | Korsunsky et al. | 439/79 |
| 6,688,897 | B2 * | 2/2004 | Korsunsky et al. | 439/108 |
| 6,692,273 | B1 * | 2/2004 | Brown et al. | 439/108 |
| 7,112,072 | B2 * | 9/2006 | Korsunsky et al. | 439/108 |
| 7,188,408 | B2 * | 3/2007 | Korsunsky et al. | 29/831 |
| 2003/0171012 | A1 * | 9/2003 | Korsunsky et al. | 439/79 |
| 2005/0095881 | A1 * | 5/2005 | Fan | 439/74 |
| 2007/0264847 | A1 * | 11/2007 | Kinoshita et al. | 439/74 |
| 2009/0004892 | A1 * | 1/2009 | Weber | 439/74 |

FOREIGN PATENT DOCUMENTS

| | | |
|---|---|---|
| JP | 2004-103527 | 4/2004 |
| JP | 2007-141586 A | 6/2007 |
| JP | 2007-141587 | 6/2007 |

OTHER PUBLICATIONS

Office Action of Japan Patent Office, Aug. 23, 2010.

* cited by examiner

*Primary Examiner* — Ross N Gushi
(74) *Attorney, Agent, or Firm* — Kubotera & Associates, LLC

(57) ABSTRACT

An electrical connector for connecting a circuit board includes a plurality of blades; a plurality of terminals disposed on each of the blades and extending in parallel to each other; and a holding member for holding the blades next to each other to be situated on a same plane. Further, each of the blades includes a base member, and the terminals are integrated with the base member.

9 Claims, 10 Drawing Sheets

ELECTRICAL CONNECTOR

BACKGROUND OF THE INVENTION AND RELATED ART STATEMENT

The present invention relates to an electrical connector for connecting two circuit boards.

Patent Reference has disclosed a conventional electrical connector. The conventional electrical connector includes a plug connector with a substantially rectangular shape disposed on one circuit board and a receptacle connector disposed on another circuit board. The receptacle connector has a recess portion for receiving a fitting portion of the plug connector through an opening portion thereof when the plug connector is connected to the receptacle connector.

Patent Reference Japanese Patent Publication No. 2007-141586

In the conventional electrical connector, the plug connector includes a housing, and a plurality of retaining grooves is formed in a pair of opposing outer side surfaces of the housing for retaining a plurality of terminals (contacts). The retaining grooves extend in a direction that the plug connector is connected to the receptacle connector (a vertical direction). The terminals with a straight shape are fitted in the retaining grooves from below, and portions of the terminals are exposed as contact surfaces.

In the conventional electrical connector, the plug connector includes retaining grooves extending in the vertical direction and formed in an inner surface of the recess portion facing the outer side surfaces of the housing for retaining mating terminals (mating contacts) when the plug connector is inserted into the recess portion of the receptacle connector. The mating terminals extend in the vertical direction, and have lower end portions (end portions near the opening portion of the recess portion) curved in a U character shape in the recess portion. A contact portion is formed at a distal end portion of each of the curved portions for elastically contacting with the contact surface of each of the terminals of the plug connector.

In the conventional electrical connector disclosed in Patent Reference, the plug connector has the terminals tightly fitted in the retaining grooves such that the terminals do not closely contact with surfaces of the retaining grooves in a longitudinal direction (a fitting direction) thereof over an entire range, thereby forming a gap where the terminals partially contact with the retaining grooves. In other words, an air layer may be formed between the terminals and the surfaces of the retaining grooves along a direction that the terminals are arranged.

Further, when some of the terminals are fitted in the retaining grooves in an inclined state relative to the vertical direction due to a dimensional variance, a size of the air layer formed in the retaining grooves may vary. In particular, when the terminals and the retaining grooves have a relatively large size in the vertical direction, the terminals tend to be fitted in the retaining grooves in a state shifted from a regular state, thereby increasing a variance of the air layer.

Recently, there has been a strong demand for reducing a size of an electrical connector. Accordingly, a connector having a small distance (pitch) between terminals has been preferably developed. When such a connector is used for transmitting a high frequency signal, it is necessary to adjust an impedance of each of the terminals. That is, it is necessary to adjust the impedance of each of the terminals at a same level.

In general, an impedance of a terminal depends on a dielectric constant of an insulating member or an air layer near the terminal. In other words, an impedance of a terminal greatly depends on a size of the insulating member or a state of the air layer along a direction that the terminal is arranged. Accordingly, in order to adjust the impedance of each of the terminals at a same level, it is necessary to arrange all of the terminals in a same condition including the state of the air layer formed between the terminals arranged next to each other.

In the conventional electrical connector disclosed in Patent Reference, when the air layer has a various size along the direction that the terminals are arranged, the impedance of each of the terminals may vary, thereby making it difficult to adjust the impedance of each of the terminals at the same level.

In view of the problems described above, an object of the present invention is to provide an electrical connector capable of reducing a variance in a dielectric constant between terminals, thereby making it possible to easily adjust an impedance of each of the terminals at a same level.

Further objects and advantages of the invention will be apparent from the following description of the invention.

SUMMARY OF THE INVENTION

In order to attain the objects described above, according to a first aspect of the present invention, an electrical connector for connecting a circuit board comprises a plurality of blades; a plurality of terminals disposed on each of the blades and extending in parallel to each other; and a holding member for holding the blades next to each other to be situated on a same plane. Further, each of the blades includes a base member, and the terminals are integrated with the base member.

In the first aspect, the blade includes the base member formed of an insulating material such as a synthetic resin, and the terminals are integrated with the base member using a molding die. When the terminals are integrated with the base member, the terminals are precisely arranged in the molding die with a specific distance therebetween, and a molten resin is injected into the molding die.

In particular, when the terminals are integrated with the base member, the molten resin is injected into the molding die while the terminals are precisely arranged in the molding die with the specific distance therebetween. When the molten resin is solidified to become the base member, the terminals are precisely integrated with the base member with the specific distance therebetween. Further, the resin is closely contacts with each of the terminals. Accordingly, there is no air layer between the base member and the terminals, thereby obtaining a uniform impedance between the terminals.

In the first aspect, the terminals are arranged with the specific distance therebetween necessary for adjusting the impedance between the terminals. When the terminals are bent in a crank shape along a direction that the terminals are arranged according to a thickness of the terminals (in a direction perpendicular to the direction that the terminals are arranged and a longitudinal direction of the terminals) and a width of the terminals (in the direction that the terminals are arranged), it is possible to adjust the specific distance between the terminals.

When the blade has a relatively small thickness, and a large number of the terminals are arranged on the blade, it may be difficult to inject the molten resin into an entire cavity of the molding die when the terminals are integrated with the base member. In this case, the molten resin may not fill in a space between the terminals. Accordingly, an air layer having a various size may be formed between the terminals, thereby making it difficult to adjust the impedance of each of the terminals at a same level.

In the first aspect, the terminals are divided into a plurality of groups, and each group of the terminals is integrated with the base member, thereby reducing a size of the blade in the direction that the terminals are arranged. Accordingly, it is possible to produce the blade using the molding die having a relatively small size. As a result, it is possible to inject the molten resin into the entire cavity of the molding die and sufficiently fill the molten resin between the terminals, thereby securely preventing an air layer from forming between the terminals.

According to a second aspect of the present invention, each of the terminals includes a connection portion for connecting to the circuit board, and the connection portion protrudes from an edge portion of the base member. Further, the holding member includes a retaining portion so that the blades are fitted in the retaining portion. In each of the terminals, the connection portion may be formed at one end portion thereof, and the other end portion is situated at an edge portion of each of the blades fitted in the retaining portion.

When the blades are tightly fitted in the retaining portion of the holding member, even if the holding member is deformed, and the terminals have a variance in a size thereof at different positions along the direction that the terminals are arranged, it is possible to properly fit the blades in the retaining portion of the holding member on a flat stage and the likes by an appropriate amount. Accordingly, it is possible to arrange the connection portions of the terminals at appropriate positions along the longitudinal direction of the terminals over an entire range in the direction that the terminals are arranged. As a result, it is possible to securely connect the terminal with a corresponding circuit on the circuit board.

According to a third aspect of the present invention, at least one of the holding member and each of the blades includes a holding protrusion for fixing the each of the blades. When the holding protrusion locally fixes each of the blades, the holding protrusion locally contacts with each of the blades in a small contact area. Accordingly, even when an external force is inadvertently applied to the holding member of the electrical connector disposed on a circuit board, it is possible to prevent the external force from transmitting from the holding member to the blade due to the small contact area or a force transmitting area. As a result, it is possible to prevent the external force from transmitting between the connection portions of the terminals and the corresponding circuit of the circuit board, thereby stably maintaining a connected state.

According to a fourth aspect of the present invention, each of the blades includes a ground plate attached to the base member for covering the terminals. With the ground plate attached to the base member, it is possible to obtain a grounding effect.

As described above, in the present invention, in each of the blades, the terminals arranged with the specific distance therebetween are integrated with the base member. Accordingly, the base member has a constant distance between the terminals in the direction that the terminals are arranged, thereby eliminating an air layer between the terminals. As a result, it is possible to obtain a uniform impedance between the terminals and to easily adjust the impedance at a same level.

Further, in the present invention, the terminals are divided into a plurality of groups, and each group of the terminals is integrated with the base member, thereby reducing a size of the molding die for forming the blade. Accordingly, it is possible to inject the molten resin into the entire cavity of the molding die and sufficiently fill the molten resin between the terminals, thereby securely preventing an air layer from forming between the terminals and to easily adjust the impedance at a same level.

BRIEF DESCRIPTION OF THE DRAWINGS

FIG. 3(A) and FIG. 3(B) are perspective views showing a blade according to the embodiment of the present invention, wherein FIG. 3(A) is a perspective view showing the blade from a side where terminals are aligned, and FIG. 3(B) is a perspective view showing the blade from a side where a ground plate is mounted;

DETAILED DESCRIPTION OF THE PREFERRED EMBODIMENTS

Hereunder, an embodiment of the present invention will be explained with reference to the accompanying drawings.

Figure 1A:
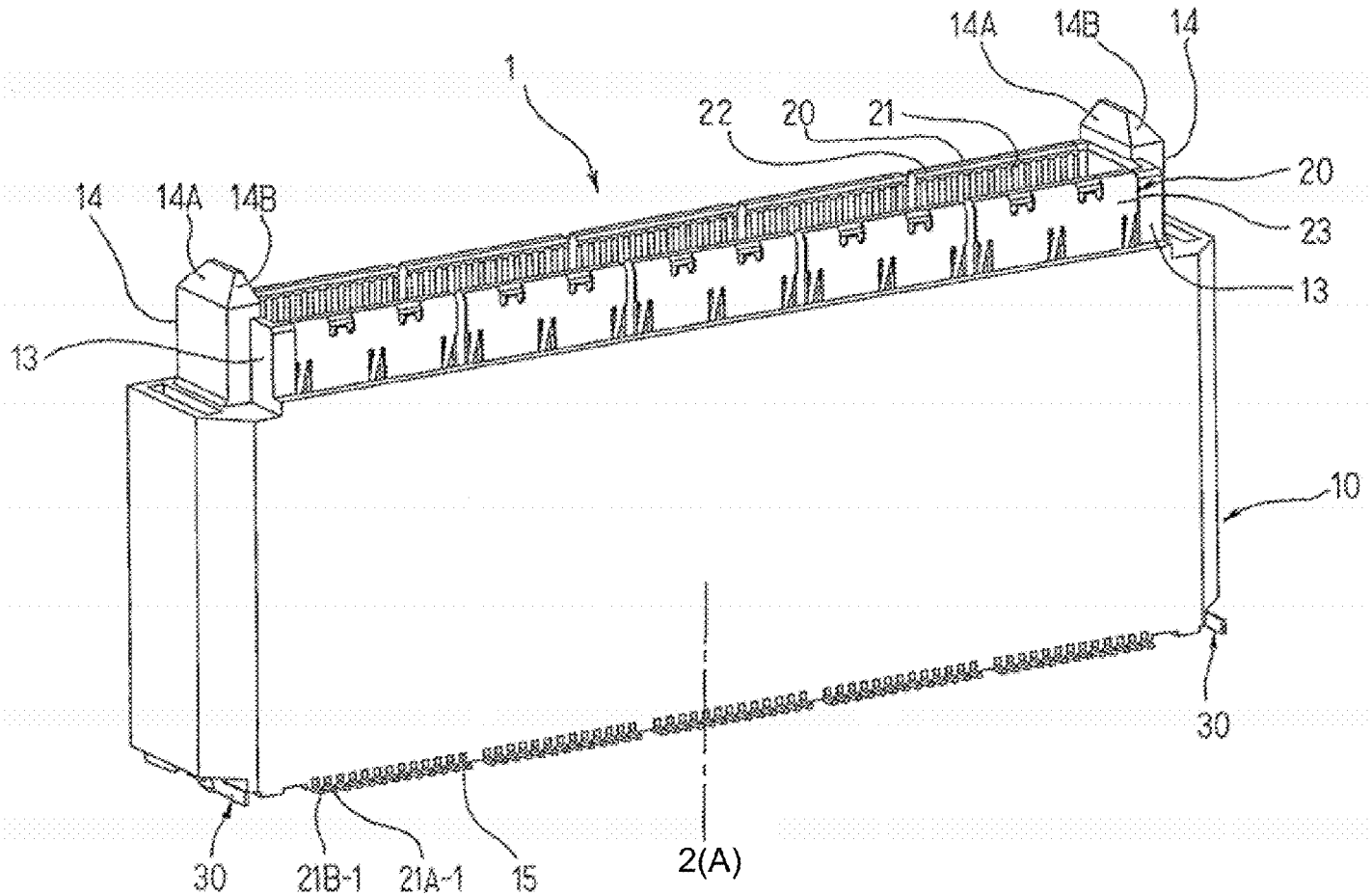
FIG. 1(A) is a perspective view showing a connector according to an embodiment of the present invention.
Figure 2A:
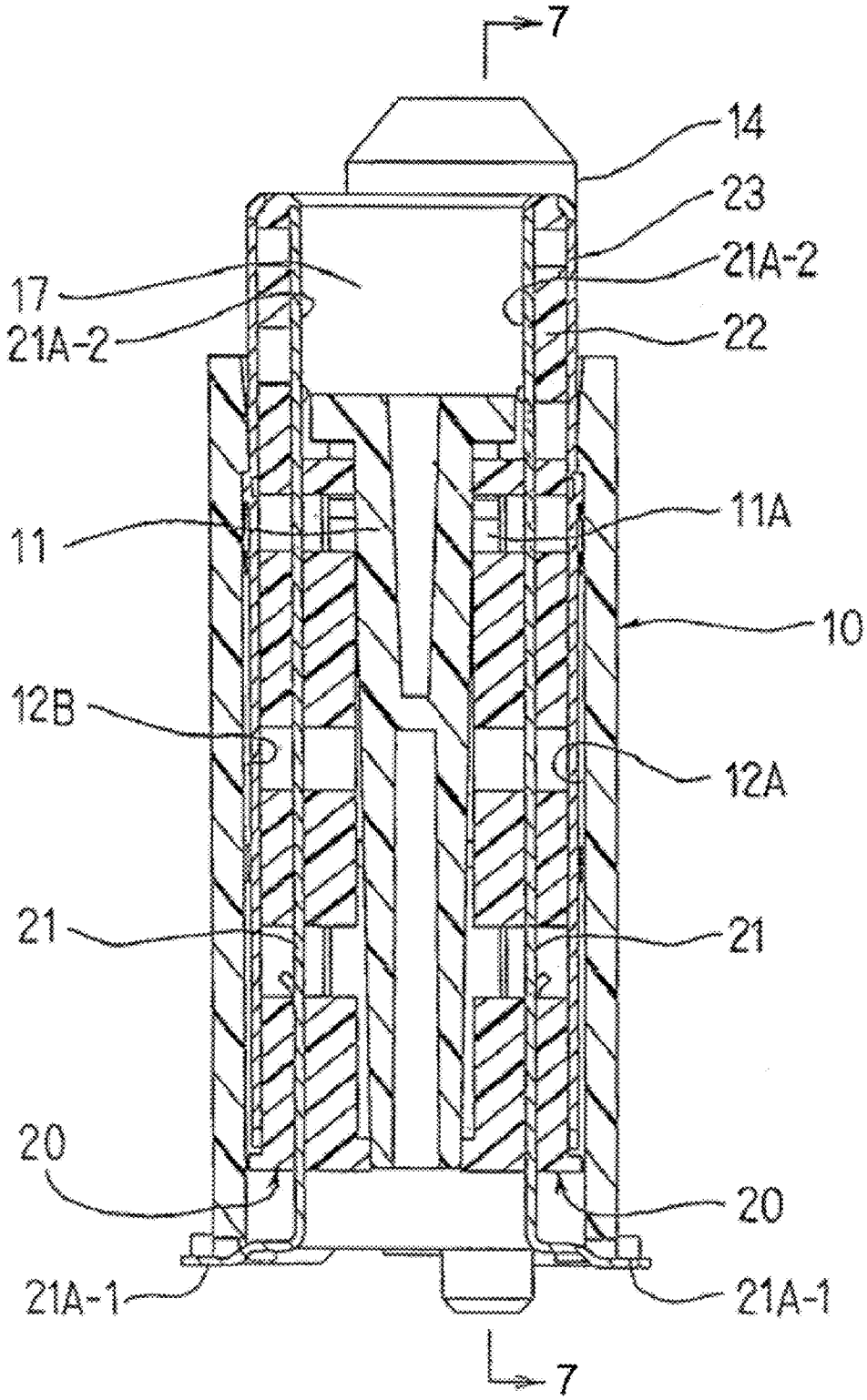
FIG. 2(A) is a sectional view showing the connector taken along a line 2(A) in FIG. 1(A) according to the embodiment of the present invention.

FIG. 1(A) is a perspective view showing an electrical connector (a connector) 1 according to an embodiment of the present invention. FIG. 2(A) is a sectional view showing the connector 1 taken along a line 2(A) in FIG. 1(A), that is, a sectional view showing the connector 1 taken at a position where one of signal terminals (described later) is situated in a terminal aligning direction.

In the embodiment, the connector 1 includes a housing 10 with an approximate rectangular shape and made from a synthetic resin; a plurality of blades 20 with a plate shape being aligned and held with the housing 10; and a plurality of fixing members 30 made from metal, for fixing the connector 1 to a circuit board (not shown).

As shown in FIG. 1(A), the connector 1 includes the plurality of the blades 20 aligned on a plane extending in a width direction (a horizontal direction in FIG. 1(A)) and a height direction (a vertical direction in FIG. 1(A)) of the connector 1. The blades 20 are aligned next to each other in the width direction of the connector 1.

In the embodiment, as shown in FIG. 1(A), the housing 10 holds the blades 20 thus aligned in a form of two rows in a thickness direction of the connector 1, that is, a direction perpendicular to both of the width direction and the height direction of the connector 1.

The blade 20 includes a plurality of terminals 21 aligned with predetermined intervals, extending in the height direction of the connector 1 in parallel on one side thereof. In the embodiment, as shown in FIG. 1(A), the two rows of the blades 20 face to each other with the side where the terminals 21 are aligned.

The housing 10 includes two openings extending in the width direction of the connector 1. The openings penetrate the housing 10 in the height direction of the connector 1. As shown in FIG. 2(A), a separating wall portion 11 is situated at a central position in the thickness direction of the connector 1 and separates the openings. As a result, two retaining portions 12A and 12B are formed in the housing 10 for accommodating the plurality of the blades 20.

In the embodiment, the retaining portions 12A and 12B may be referred to as "a retaining portion 12" inclusively, in a case there is no need to distinguish between the retaining portions 12A and 12B.

Figure 7:
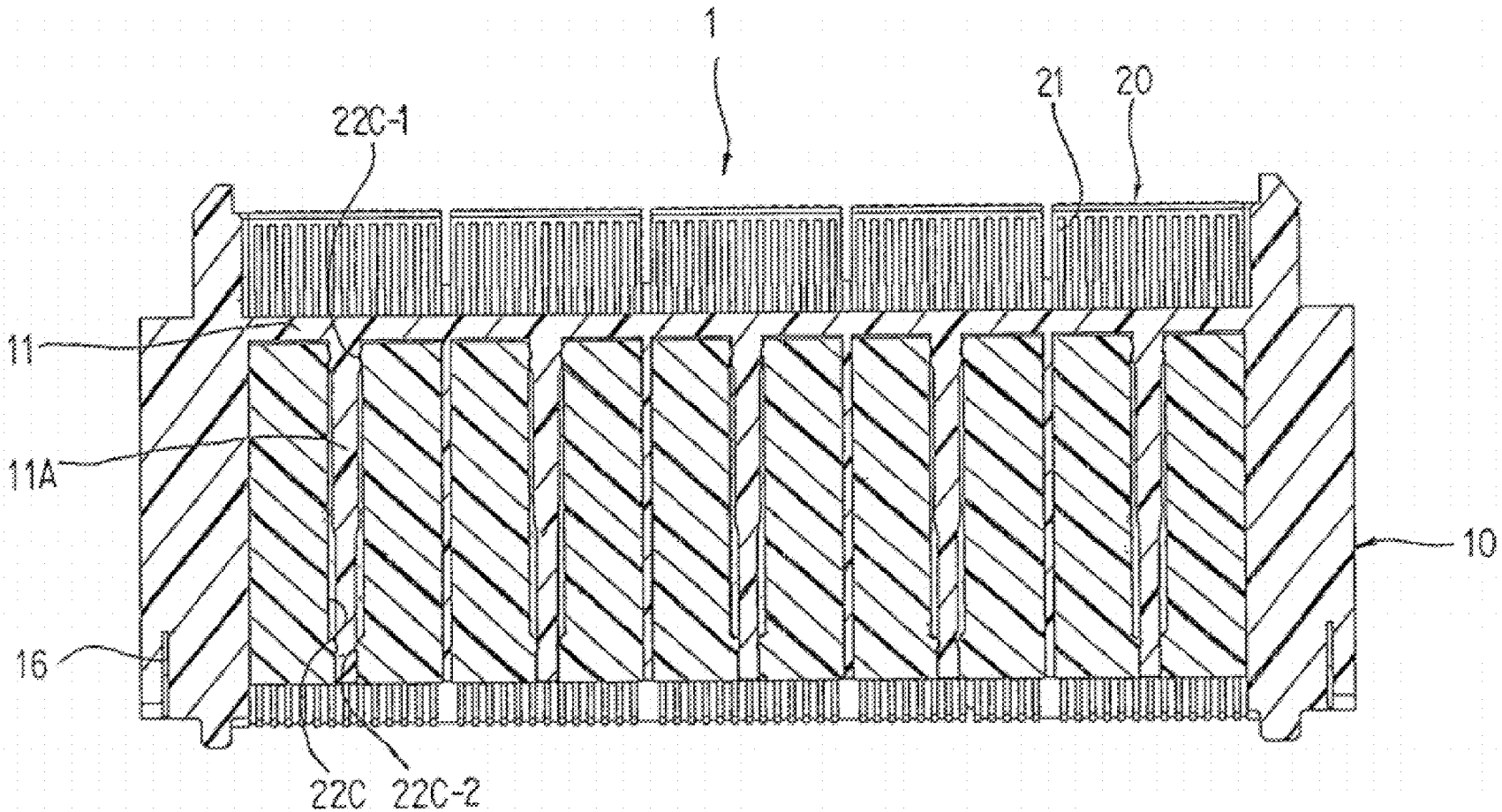
FIG. 7 is a sectional view showing the connector taken along a line 7-7 in FIG. 2(A) according to the embodiment of the present invention.

As shown in FIG. 7, the separating wall portion 11 includes a plurality of elongated protruding portions 11A for holding the blade 20 on both sides thereof. The elongated protruding portions 11A are aligned with intervals in the width direction of the connector 1, and each of the elongated protruding portions 11A extends in the height direction of the connector 1. The elongated protruding portion 11A has a tapered width in the width direction of the connector 1, from an upper end toward a lower end thereof. As described later, the elongated protruding portion 11A is pressed into a holding groove 22C (described later) of the blade 20, in order to hold the blade 20 when the blade 20 is inserted into the retaining portion 12 from a lower side of the housing 10.

As shown in FIG. 1(A), the housing 10 includes an end wall portion 13. The end wall portion 13 is situated at both ends of the housing 10 in the width direction of the connector 1 of both sides in the thickness direction of the connector 1. The end wall portion 13 extends from an upper end portion of the housing 10 in an upper direction. The housing 10 further includes a guiding portion 14 formed integrally with the end wall portion 13 on the upper end portion thereof. The guiding portion 14 extends in the upper direction at a middle position in the thickness direction of the connector 1.

The guiding portion 14 has an approximate rectangular parallelepiped shape, protruding an upper end portion thereof in the upper direction further than the end wall portion 13. The upper end portion of the guiding portion 14 has a shape tapered from the lower to the upper direction. The tapered shape of the guiding portion 14 includes guiding surfaces 14A and 14B for guiding a mating connector 2 (described later) to a right connecting position when the mating connector 2 is connected to the connector 1.

The guiding surface 14A has a slope in the width direction of the connector 1, while the guiding surface 14B has a slope in the thickness direction of the connector 1. Accordingly, the guiding surface 14A guides the mating connector 2 to the right connecting position in the width direction of the connector 1, while the guiding surface 14B guides the mating connector 2 to the right connecting position in the thickness direction of the connector 1.

As shown in FIG. 1(A), the housing 10 includes a groove portion 15 on the lower end extending in the width direction of the connector 1 thereof. The groove portion 15 is formed at a position corresponding to the terminal 21 and allows a connecting portion 21A-1 or 21B-1 (described later) formed in a lower end portion of the terminal 21 to extend outside of the housing 10. In addition, as shown in FIG. 7, the housing 10 includes a holding slit portion 16 for holding the fixing member 30 at both ends of a lower surface thereof in the width direction of the connector 1. The holding slit portion 16 has a slit shape extending in the height direction of the connector 1.

Figure 3A:
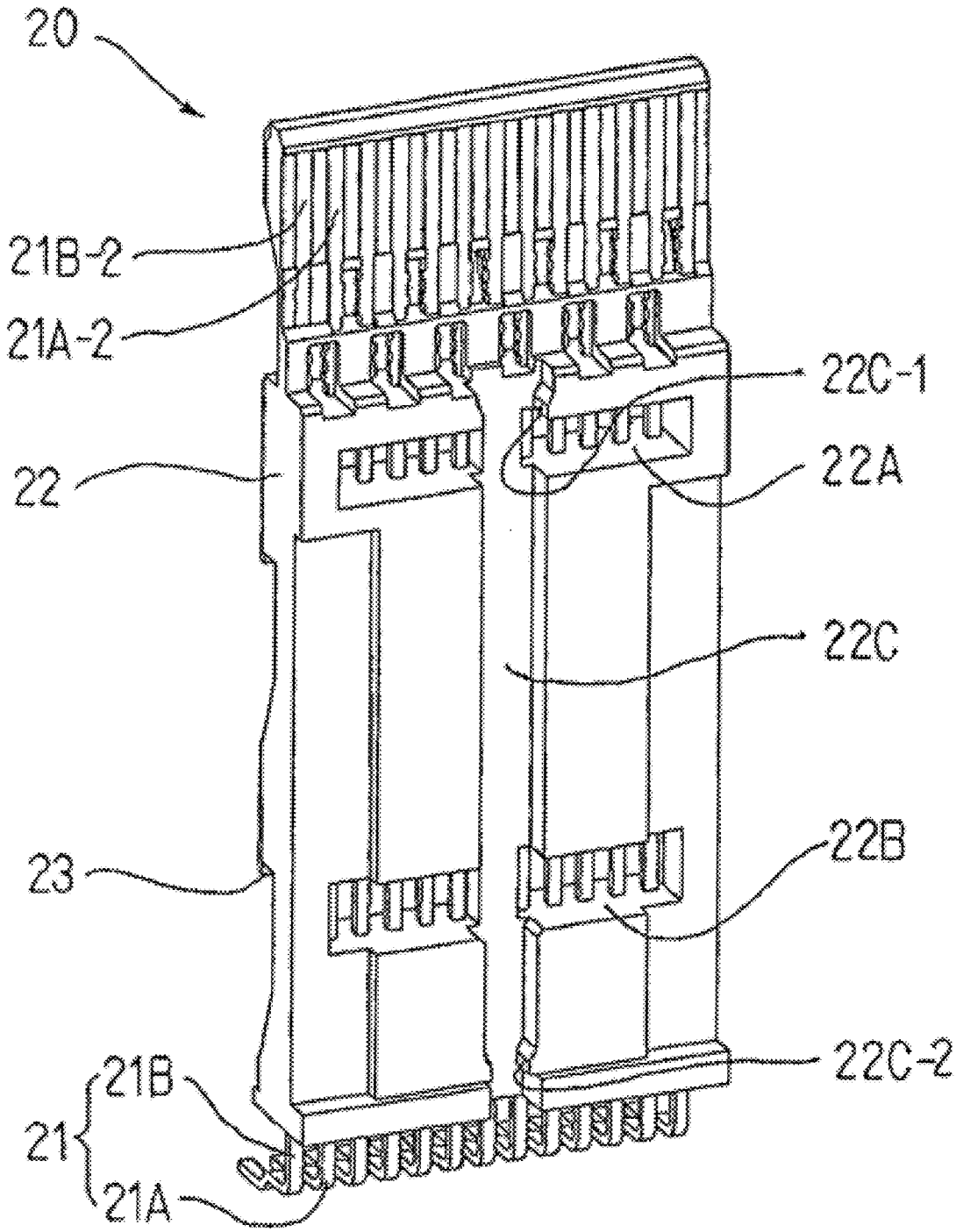
Figure 3B:
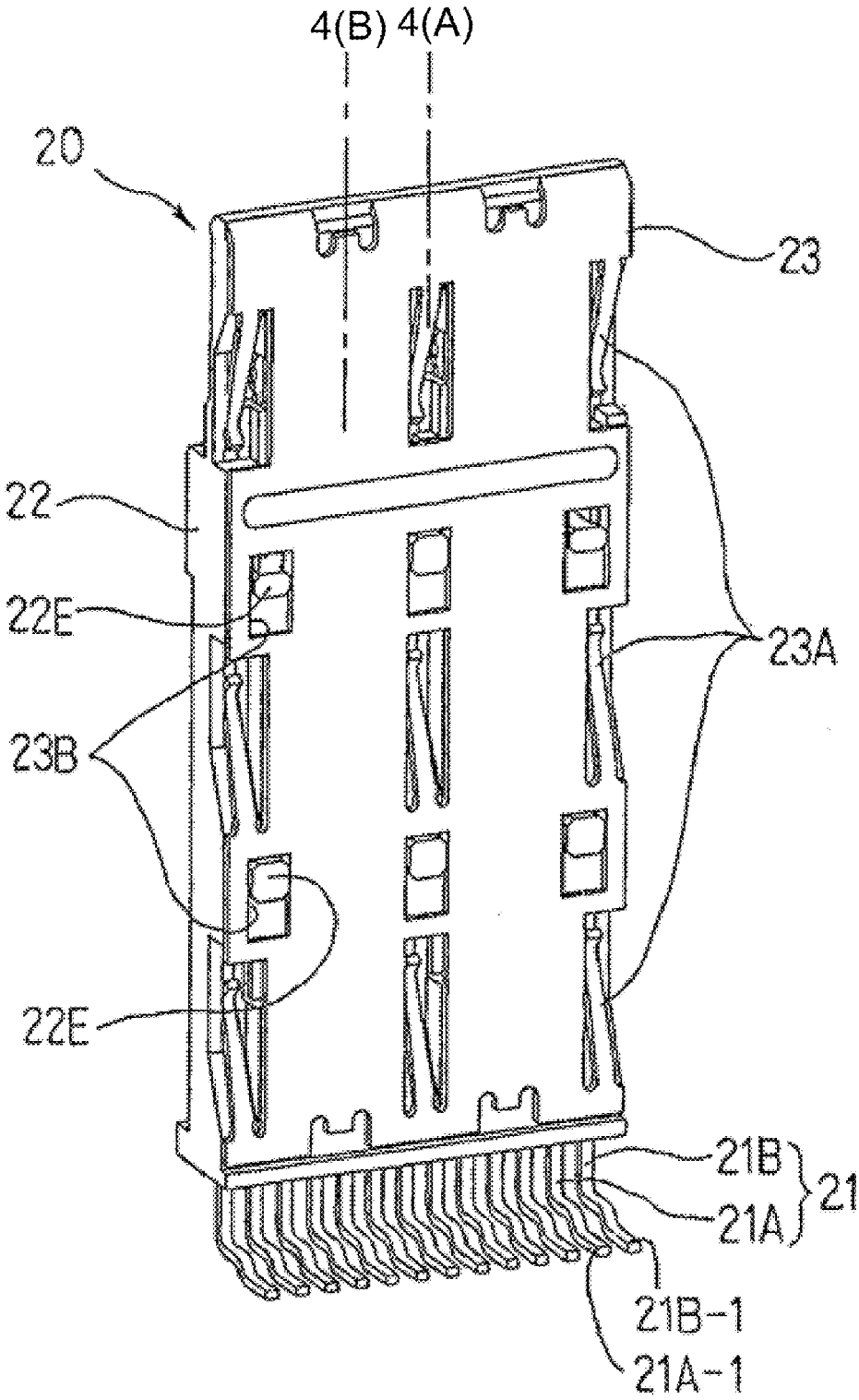

FIG. 3(A) is a perspective view showing the blade 20 from a side where the terminals 21 are aligned, and FIG. 3(B) is a perspective view showing the blade 20 from a side where a ground plate 23 is mounted. The blade 20 includes the plurality of the terminals 21 aligned on one side of a base member 22 made from a synthetic resin. The plurality of the terminals 21 is formed integrally with the base member 22.

The blade 20 further includes the ground plate 23 on another side of the base member 22. The ground plate 23 is fixed to the base member 22 so as to cover a range where the plurality of the terminals 21 is aligned. The terminals 21 are aligned with predetermined intervals, extending toward the height direction of the connector 1 in parallel. In other words, in order to attain impedance matching for all terminals 21, the interval between the terminals 21 is predetermined. In the embodiment, the terminals 21 are aligned with equal intervals.

The plurality of the terminals 21 of the blade 20 includes signal terminals 21A and ground terminals 21B. As shown in FIG. 3(B), in the embodiment, among the all terminals 21 of the blade 20, the terminals 21 situated at a center and both ends are used as the ground terminal 21B. The rest of the terminals 21 of the blade 20 are used as the signal terminals 21A. In the embodiment, the signal terminal 21A and the ground terminal 21B may be mentioned as "terminal 21" inclusively, in a case there is no need to distinguish between the signal terminal 21A and the ground terminal 21B.

The terminal 21 protrudes a lower end portion protruding from a lower end edge of the base member 22. As shown in FIG. 2(A), the lower end portion of the terminal 21 protruding from the lower end edge of the base member 22 is bent at an approximate right angle toward an outside of the connector 1 in the thickness direction of the connector 1. Thereby the connecting portion 21A-1 in a case the terminal 21 is the signal terminal 21A, and the connecting portion 21B-1 in a case the terminal 21 is a ground terminal 21B are provided.

Further, as shown in FIGS. 3(A) and 2(A), the terminal 21 includes contact portions 21A-2 and 21B-2 at an upper end portion thereof for contacting with a terminal of the mating connector 2 when the mating connector 2 is connected to the connector 1. When the terminal 21 is the signal terminal 21A, the contact portion is designated as 21A-2 and the contact portion is designated as 21B-2 when the terminal 21 is a ground terminal 21B As shown in FIG. 3(A), the contact portions 21A-2 and 21B-2 are exposed from a plate surface at an upper portion of the blade 20. In addition, as shown in FIG. 3(B), the connecting portions 21A-1 and 21B-1 protrude from the lower end of the base member 22. The terminal 21 is buried in the base member 22 at a straight extending portion thereof between the connecting portion 21A-1 and the contact portion 21A-2 in the case the terminal 21 is the signal terminal 21A and between the connecting portion 21B-1 and the contact portion 21B-2 in the case the terminal 21 is the signal terminal 21B thereof, except at hole portions 22A and 22B of the base member 22.

The hole portions 22A and 22B are located at two positions in a longitudinal direction of the terminal 21 or a vertical direction in FIG. 3(A). The hole portions 22A and 22B penetrate the base member 22 in a thickness direction of a plate. The terminal 21 are exposed within the hole portions 22A and 22B. The hole portions 22A and 22B are provided in order to hold the terminal 21 being positioned in a mold or a molding die when the blade 20 is manufactured. It is preferable that the hole portions 22A and 22B are located at positions considered for impedance matching.

As shown in FIG. 3(A), the base member 22 includes the holding groove 22C extending in the longitudinal direction of the terminal 21 at a central portion in the terminal aligning direction thereof. As shown in FIG. 7, when the blade 20 is inserted into the retaining portion 12 of the housing 10, the elongated protruding portion 11A provided on the separating wall 11 of the housing 10 is pressed into the holding groove 22C, thereby holding the blade 20. The holding groove 22 has a width tapered from an upper end toward a lower end thereof, corresponding to the width of the elongated protruding portion 11A.

The holding grove 22C includes holding protruding portions 22C-1 and 22C-2 at an upper portion and a lower portion thereof, respectively. Each of the holding protruding portions 22C-1 and 22C-2 is a pair of protrusions facing each other provided on either side surface of the holding groove 22.

As shown in FIG. 3(B), the ground plate 23 made from metal is fixed so as to cover a whole plate surface on another side of the base member 22. In the embodiment, a distance between the terminal 21 and the ground plate 23 is larger than a distance between the terminals 21 next to each other. Thereby it is possible to make the ground plate 23 not to influence impedance of each terminal 21 adjusted with the intervals between the terminals 21.

The ground plate 23 includes a ground piece 23A cut and bent toward the base member 22. The ground pieces 23A are provided at both end portions and a central portion of the ground plate 23 in the terminal aligning direction and three locations, that is, upper, lower and middle portions of the ground plate 23 in the longitudinal direction of the terminal 21. The ground piece 23A has a shape like an arm. In the embodiment, the ground terminal 21B has a corresponding position to the ground piece 23A. As shown in FIG. 3(B), the ground piece provided at the upper portion extends toward a lower direction while the ground pieces provided at the middle and the lower portions extend toward an upper direction.

Figure 4B:
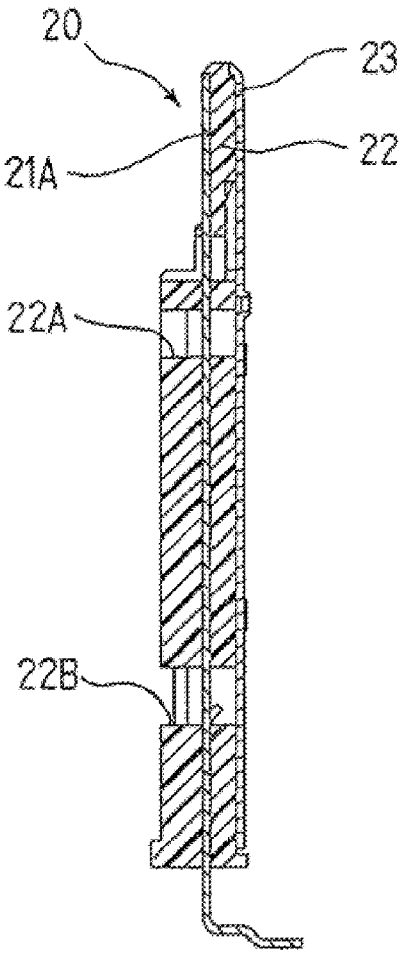
FIG. 4(B) is a sectional view showing the blade taken along a line 4(B) in FIG. 3(B) according to the embodiment of the present invention.
Figure 4A:
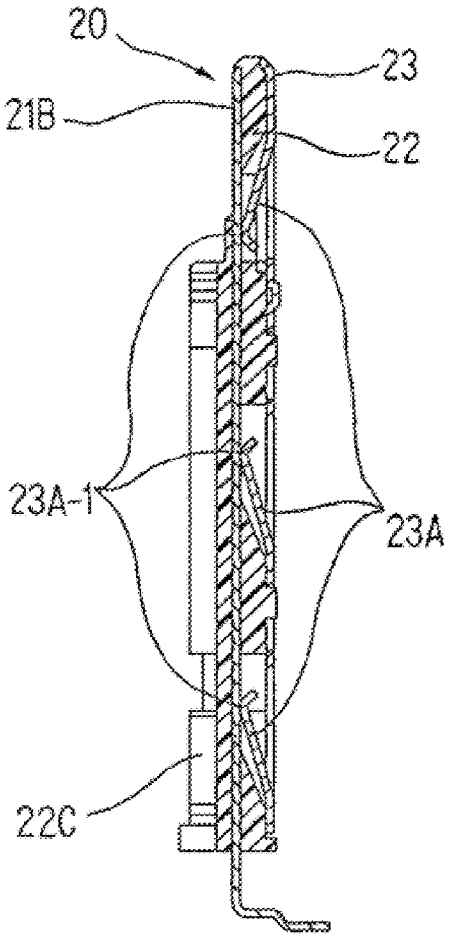
FIG. 4(A) is a sectional view showing the blade taken along a line 4(A) in FIG. 3(B) according to the embodiment of the present invention.

FIG. 4(A) is a sectional view showing the blade 20 taken along a line 4(A) in FIG. 3(B), in other words, taken at a position the ground terminal 21B is situated. In addition, FIG. 4(B) is a sectional view showing the blade 20 taken along a line 4(B) in FIG. 3(B), in other words, taken at a position the signal terminal 21A is situated. As shown in FIG. 4(A), the ground piece 23A includes a contact portion 23A-1 for contacting with the ground terminal 21B. The contact portion 23A-1 is provided by bending a forefront portion of the ground piece 23A convexly, so as to confront to the plate surface of the base member 22. The ground piece 23A contacts with the ground terminal 21B elastically with the contact portion 23A-1 thereof, thereby the connector 1 with the blade 20 is able to obtain a ground effect.

Moreover, as shown in FIG. 3(B), the ground plate 23 includes a mounting hole portion 23B for mounting to the plate surface of the base member 22. The mounting hole portion 23B is located between the ground pieces 23A in the longitudinal direction of the terminal 21. The mounting hole portion 23B has an approximate rectangular shape and has a slightly narrower width at an upper portion thereof than a width at a lower portion thereof.

Figure 5:
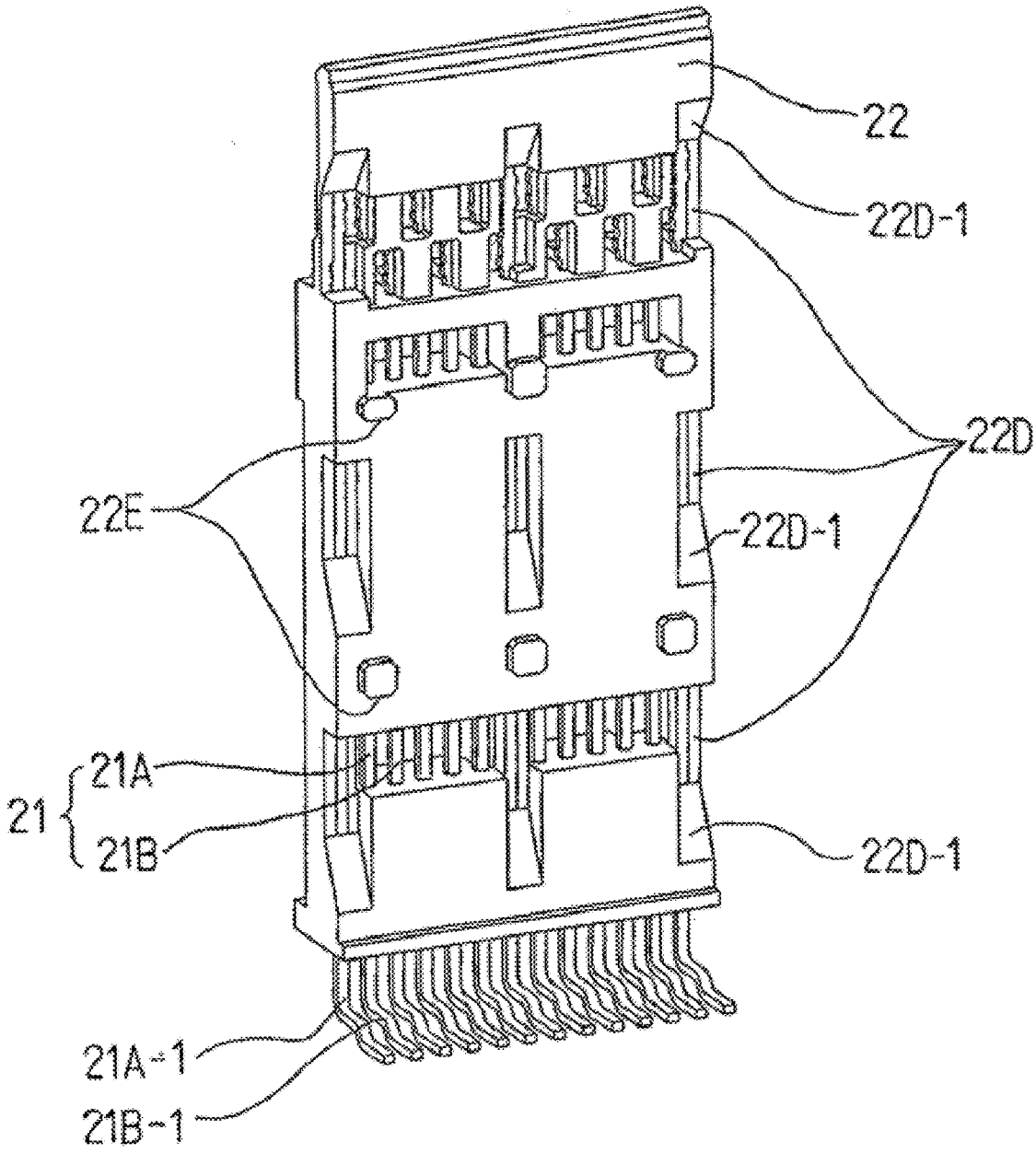
FIG. 5 is a perspective view showing the blade in a state that the ground plate is not mounted thereto according to the embodiment of the present invention.

FIG. 5 is a perspective view showing the blade 20 in FIG. 3(B) in a state that the ground plate 23 is not mounted thereto. As shown in FIG. 5, a surface of the base member 22 the ground plate 23 is mounted or a mounted surface includes a recess portion 22D in order to allow the ground piece 23A to enter. The recess portion 22D is provided at a position corresponding to the ground piece 23A of the ground plate 23. As shown in FIG. 5, the recess portion 22D includes a sloping surface 22D-1 having a slope along a slope of the corresponding ground piece 23A.

The mounted surface further includes a protruding portion 22E at a position corresponding to the mounting hole portion 23B of the ground plate 23. The protruding portion 22E has a box cross-sectional shape. The protruding portion 22E has a slightly narrower width than the width of an approximate lower half portion of the mounting hole portion 23B in the terminal aligning direction. Further, the protruding portion 22E has a slightly larger width than the width of an approximate upper half portion of the mounting hole portion 23B in the terminal aligning direction. A process of mounting the ground plate 23 onto the base member 22 will be described later.

Next, a process from manufacturing the blade 20 to pressing the blade 20 into the housing 10 will be explained. First, the plurality of the terminals 21 having a plate shape extending in straight is aligned in the mold. The terminals 21 are in a state that the connecting portions 21A-1 and 21B-1 and the contact portions 21A-2 and 21B-2 are not provided yet, that is, not yet bent in the thickness direction of the plate. The terminals 21 are aligned with the predetermined intervals.

Next, the plurality of the terminals 21 and the base member 22 are formed integrally by pouring a melting resin in the mold. Note that the terminal 21 is aligned so as to protrude one end thereof toward outside the mold, so that one end of the terminal protrudes from one end of the base member 22. Next, the connecting portions 21A-1 and 21B-1 are provided at the same time, by bending all of the ends of the terminals 21 protruding from the end of the base member 22. Thus an integrally molded object is provided having the terminals 21 and the base member 22, as shown in FIG. 5.

Next, the base member 22 is inserted into the ground plate 23 in order to attach the ground plate 23 closely to the plate surface of the base member 22. The protruding portion 22E is inserted into the approximate lower half portion of the mounting hole portion 23B, in other words, a portion slightly wider than the width of the protruding portion 22E of the mounting hole portion 23B of the ground plate 23. The ground plate 23 is slid to the lower direction maintaining a state attached to the base member 22 closely.

Accordingly, the protruding portion 22E is pressed into the approximate upper half portion of the mounting hole portion 23B, in other words, a portion slightly narrower than the width of the protruding portion 22E of the mounting hole portion 23B, in the longitudinal direction of the terminal 21. As a result, an approximate upper inner edge of the mounting hole portion 23B cuts into an outer edge of the protruding portion 22E. Thereby the ground plate 23 is mounted onto the base member 22, thus the manufacturing process of the blade 20 is completed.

Figure 6:
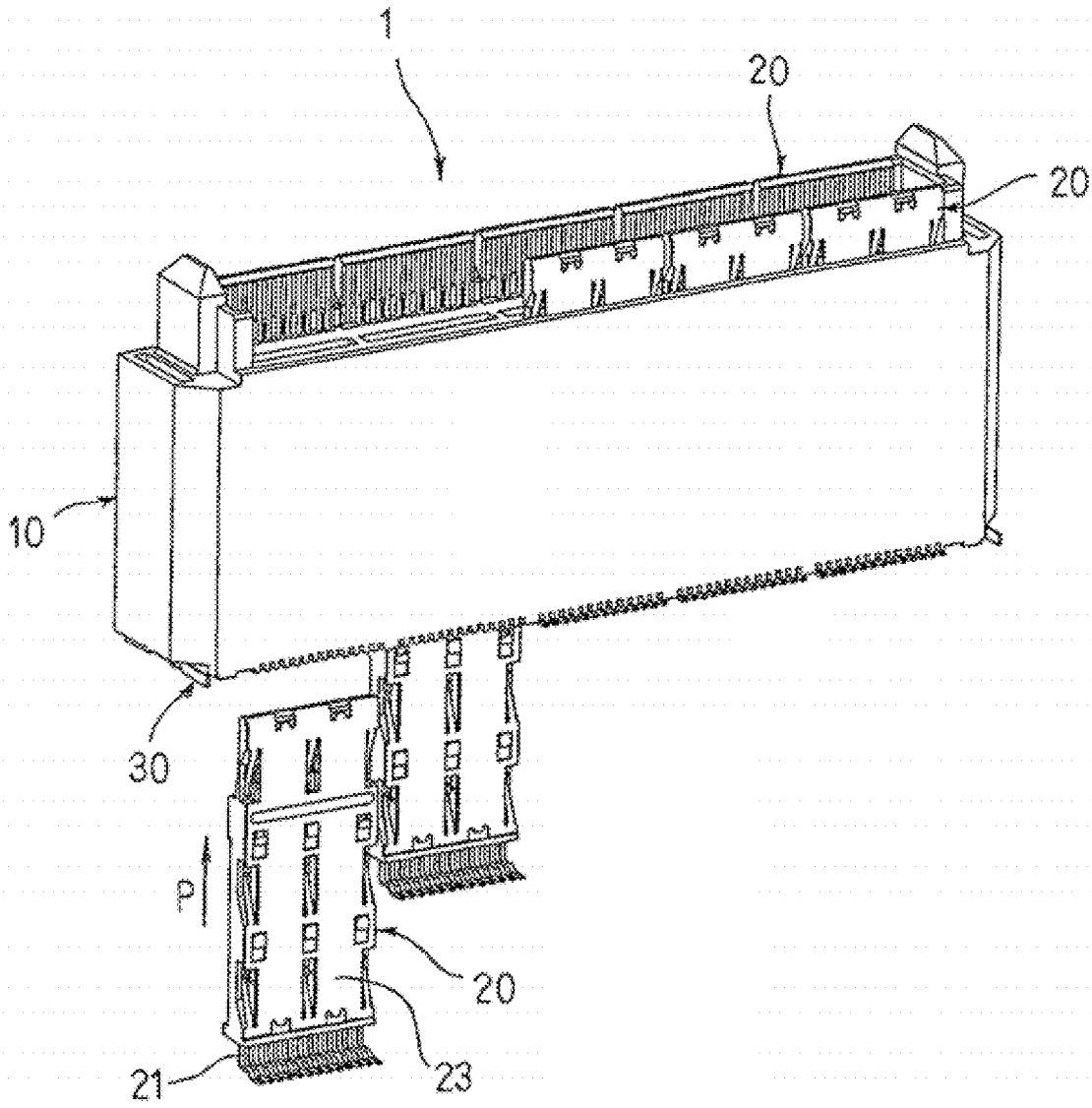
FIG. 6 is a perspective view showing the connector in a state that some of the blades are extracted according to the embodiment of the present invention.

Next, the blade 20 thus manufactured is inserted into the retaining portion 12. As shown in FIG. 6, the blade 20 is inserted into the retaining portion 12 from a side the contact portions 21A-2 and 21B-2 are situated, through a lower opening portion of the retaining portion 12 in the direction of an arrow P in FIG. 6. At this time, the plate surface of the blade 20 the ground plate 23 is mounted faces outside the housing 10 in the thickness direction of the connector 1.

When the blade 20 is inserted into the retaining portion 12, the elongated protruding portion 11A provided on the separating wall 11 of the housing 10 is inserted into the holding groove 22C of the blade 20 in the longitudinal direction of the terminal 21 or the height direction of the connector 1. The holding protruding portions 22C-1 and 22C-2 provided in the holding groove 22C sandwich and hold the elongated protruding portion 11A in the width direction of the connector 1, or the terminal aligning direction. Accordingly, the housing 10 is able to hold the blade 20.

As shown in FIGS. 1(A) and 2(A), the blade 20 thus inserted penetrates the retaining portion 12. In addition, the blade 20 protrudes the upper portion thereof, that is, the portion the contact portions 21A-2 and 21B-2 are situated thereof, from the upper end portion of the housing 10. In the embodiment, the blade 20 is inserted into the housing 10 to a state that an upper end portion of the blade 20 reaches to an approximate same height with the upper end portion of the end wall portion 13. Further, as shown in FIG. 2(A), a receiving opening 17 is provided between the upper portions of the blades 20. The receiving opening 17 receives a central wall portion 42 of the mating connector 2 when the mating connector 2 is connected to the connector 1 (described later).

FIG. 7 is a sectional view showing the connector 1 taken along a line 7-7 in FIG. 2(A). As shown in FIG. 7, the elongated protruding portion 11A of the housing 10 holds the blade 20 at two places in the longitudinal direction of the terminal 21, at positions the holding protruding portions 22C-1 and 22C-2 are situated. Hollow portions are provided between the elongated protruding portion 11A and the holding groove 22C, except the positions the holding protruding portions 22C-1 and 22C-2 are situated. Between an outer edge portion of the blade 20 and an inner edge portion of the retaining portion 12, hollow portions are provided as well.

As shown in FIG. 1(A), the connecting portions 21A-1 or 21B-1 of the terminal 21 protrudes outside the connector 1 from the groove portion 15. The connecting portions 21A-1 and 21B-1 are soldered to corresponding circuit portions of the circuit board (not shown) in order to connect the connector 1 to the circuit board electrically.

As shown in FIG. 1(A), the fixing member 30 for fixing the connector 1 to the circuit board is provided at the both ends in the width direction of the connector 1 of the lower surface of the housing 10. The fixing member 30 is made from a metal plate. And as shown in FIG. 7, the fixing member 30 is mounted to the housing 10 by pressing a portion thereof into the holding slit portion 16.

In the width direction of the connector 1, two fixing members 30 are provided at each of end portions of the housing 10. The fixing members 30 at each of the end portions of the housing 10 include portions protruding toward the lower direction from the holding slit portion 16 and extending in a direction away from each other in the thickness direction of the connector 1. The fixing member 30 is soldered to the circuit board at a lower edge thereof, thereby being fixed on the circuit board.

Figure 1B:
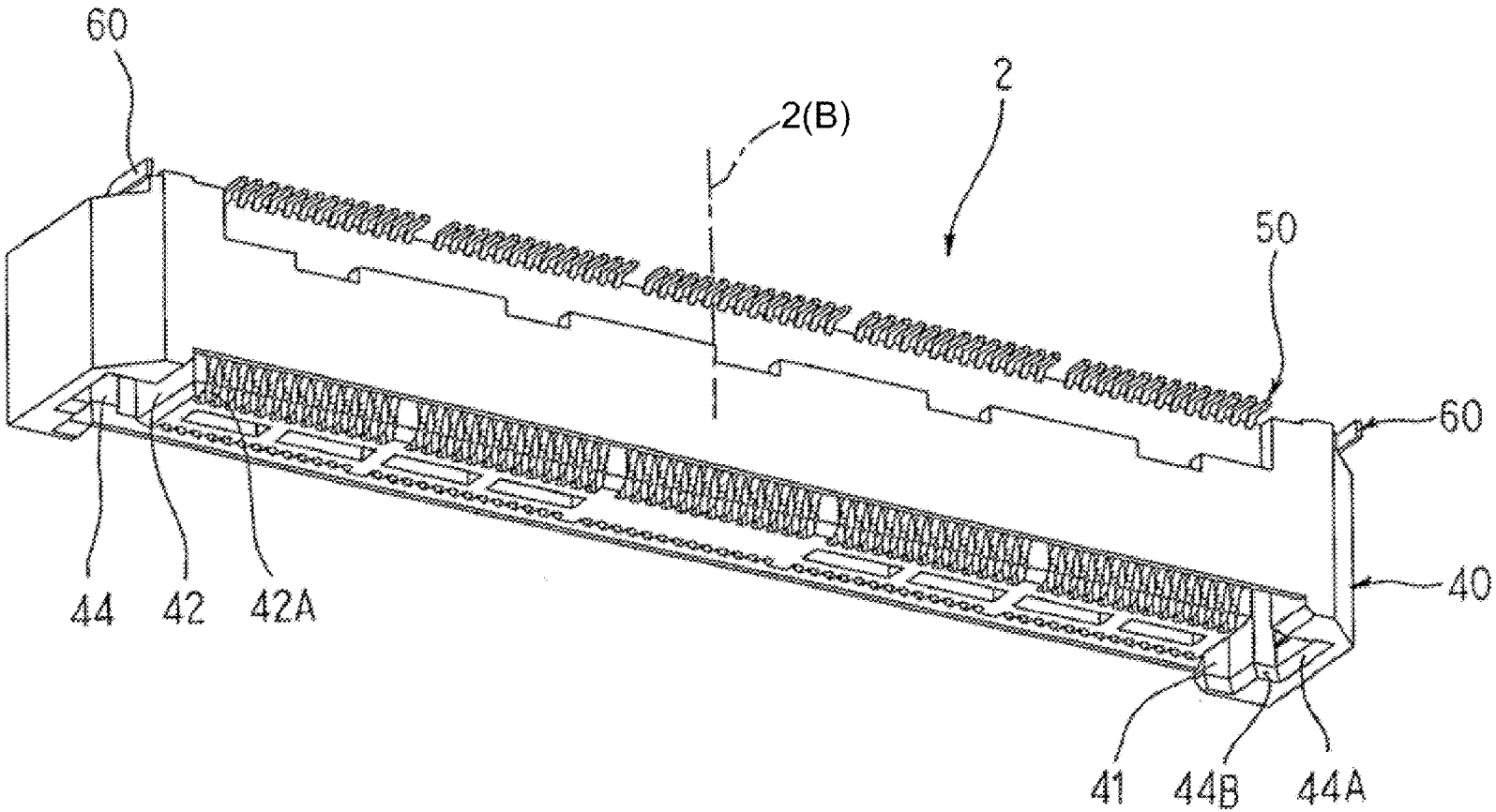
FIG. 1(B) is a perspective view showing a mating connector according to the embodiment of the present invention.
Figure 2B:
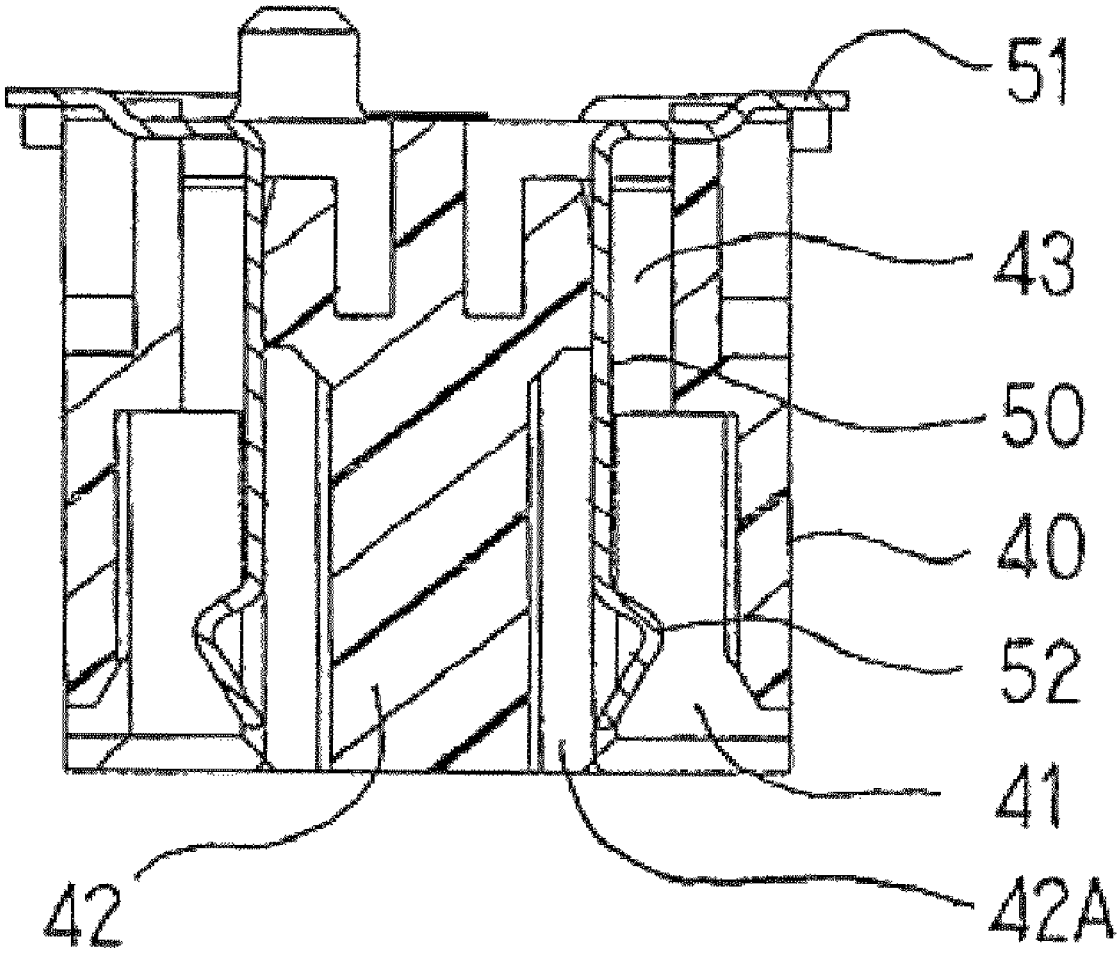
FIG. 2(B) is a sectional view showing the mating connector taken along a line 2(B) in FIG. 1(B) according to the embodiment of the present invention.

FIG. 1(B) is a perspective view showing the mating connector 2 to be connected to the connector 1 from a lower side. FIG. 2(B) is a sectional view showing the mating connector 2 taken along a line 2(B) in FIG. 1(B). The mating connector 2 includes a housing 40 with an approximate rectangular shape and made from a synthetic resin; a plurality of terminals 50 aligned and held by the housing 40 in a longitudinal direction of the housing 40; and a plurality of fixing members 60 made from metal, for fixing the mating connector 2 onto a circuit board.

As shown in FIG. 2(B), the housing 40 includes a receiving opening 41 for receiving the upper portion of the blade 20 of the connector 1 when the mating connector 2 is connected to the connector 1. The receiving opening 41 opens toward a lower direction of the housing 40. The housing 40 further includes the central wall portion 42 at a central portion of the receiving opening 41, extending to an approximate whole range of the receiving opening 41 in a width direction of the housing 40, that is, a width direction of the mating connector 2.

The central wall portion 42 has an island shape in the cross-sectional view in FIG. 2(B). Accordingly, the receiving opening 41 is situated between the central wall portion 42 and a circumference wall of the housing 40, surrounding the central wall portion 42. As shown in FIG. 2(B), the receiving opening 41 is situated at a lower half portion of the housing 40. The housing 40 further includes a terminal holding groove 53 for holding the terminal 50 at an upper half portion thereof. The terminal holding groove 53 penetrates through the housing 40 from the lower direction to an upper direction, and connects to the receiving opening 41. As described later, the terminal 50 is held with an inner surface of the holding groove 53.

As shown in FIG. 1(B) and FIG. 2(B), the central wall portion 42 includes a terminal accommodating groove 42A on side wall surface thereof. The terminal accommodating groove 42A extends from the lower direction to the upper direction in a range of a lower half portion of the side wall surface.

As shown in FIG. 2(B), the terminal 50 is formed by bending a metal plate in a thickness direction thereof at an upper end side thereof. Thus the terminal 50 has an approximate upside-down L-shape. The terminal 50 is bent at an approximate right angle at an upper end portion thereof, and extends at an upper end portion thereof in a direction perpendicular to both of the width direction and the height direction of the mating connector 2, or a thickness direction of the mating connector 2. The upper end portion of the terminal 50 is formed as a connecting portion 51 for connecting to a corresponding circuit portion of the circuit board (not shown). In addition, the terminal 50 includes a contact portion 52 for contacting with the terminal 21 of the connector 1 in the receiving opening 41. The contact portion 52 is formed by bending a lower end portion of the terminal 50 so as to curve convexly to an extending direction of the connecting portion 51.

The terminal 50 working as a signal terminal is situated at a position corresponding to the signal terminal 21A of the connector 1 while the terminal 50 working as a ground terminal is situated at a position corresponding to the ground terminal 21B of the connector 1. As described later, when the mating connector 2 is connected to the connector 1, the terminal 50 contacting with the terminal 21 of the connector 1 deforms elastically toward the central wall portion 42 then the terminal accommodating groove 42A accommodates the deformed portion of the terminal 50.

The terminal 50 is inserted into the housing 40, the contact portion 52 thereof first. The terminal 50 enters the housing 40 toward the lower direction through a terminal holding groove 43. The terminal holding groove 43 sandwiches and holds the terminal 50 with inner surfaces thereof, at both end edges in an upper portion of the terminal 50 in the height direction of the mating connector 2. As shown in FIG. 2(B), the contact portion 52 is situated in the receiving opening 41 and the connecting portion 51 extends from an upper opening portion of the terminal holding groove 43 toward an outside of the mating connector 2 in the thickness direction of the mating connector 2.

As shown in FIG. 1(B), the housing 40 further includes a guided portion 44, opening toward the lower direction at both end portions of the lower end thereof in the width direction of the mating connector 2. The guided portion 44 receives the guiding portion 14 of the connector 1 when the mating connector 2 is connected to the connector 1. The guided portion 44 includes a guided surface 44A having a slope in the width direction of the mating connector 2 and a guided surface 44B having a slope in the thickness direction of the mating connector 2 at an opening edge portion thereof.

When the mating connector 2 is connected to the connector 1, the guiding surface 14A abuts the guided surface 44A and the guiding surface 14B abuts the guided surface 44B to guide the guided portion 44 to the right connecting position in the width and thickness directions of the connector 1 and the mating connector 2 (the connectors), even if the mating connector 2 is slightly displaced from the right connecting position in the width direction or the thickness direction of the connectors. Accordingly, the mating connector 2 is guided to the right connecting position as the guided portion 44 enters the guiding portion 14 easily as the mating connector 2 is connected to the connector 1.

The fixing member 60 for fixing the mating connector 2 to the circuit board is provided at both end portions in the width direction of the mating connector 2 of an upper surface of the housing 40. The fixing member 60 is made from metal plate and the fixing member 60 is mounted to the housing 40 by pressing a portion thereof into a holding slit portion having a slit shape (not shown). Two fixing members 60 are provided at each of end portions of the housing 40 in the width direction of the mating connector 2. The fixing members 60 at each of the end portions of the housing 40 include portions protruding toward the upper direction from the holding slit portion and extending in a direction away from each other, in the thickness direction of the mating connector 2. The fixing member 60 is soldered to the circuit board at an upper edge portion thereof, thereby the mating connector 2 is fixed on the circuit board.

Next, an operation of connecting the mating connector 2 to the connector 1 will be explained.

As the mating connector 2 is connected to the connector 1 from the upper direction, the central wall portion 42 of the mating connector 2 and the contact portion 52 of the terminal 50 enter the receiving opening 17 of the connector 1 from the upper direction. At the same time, the upper end portion of the blade 20 aligned in a form of two rows, that is, the contact portions 21A-2 and 21B-2 of the terminal 21 enter the receiving opening 41 of the mating connector 2 from the lower direction.

When the connector 1 and the mating connector 2 are slightly displaced from the right connecting position in the width or thickness direction of the connectors, the guiding surface 14A of the connector 1 guides the guided surface 44A of the mating connector 2 in the width direction of the connectors and the guiding surface 14B of the connector 1 guides the guided surface 44B of the mating connector 2 in the thickness direction of the connectors. Accordingly, the mating connector 2 is placed to the right connecting position with the connector 1.

The contact portion 52 of the terminal 50 of the mating connector 2 enters the receiving opening 17 of the connector 1 then contacts with the contact portion 21A-2 or 21B-2 of the blade 20 inside the receiving opening 17. The contact portions 21A-2 and 21B-2 press the contact portion 52 toward an inner direction in the thickness direction of the connectors. Thus, the contact portion 52 displaces elastically to be accommodated in the terminal accommodating groove 42A. Next, a lower surface of the central wall portion 42 of the mating connector 2 abuts against an upper surface of the separating wall portion 11, thereby preventing the central wall portion 42 from entering further and the operation of connecting the mating connector 2 to the connector 1 is thus completed.

In the embodiment, the blade 20 is formed by molding integrally the base member 22 of the synthetic resin with the plurality of the terminals 21 aligned with the equal intervals. Accordingly, the base member 22 has an equal dimension between the terminals 21. In addition, an air gap is not formed between the base member 22 and the terminal 21, since the synthetic resin adheres to the terminal 21. As a result, it obtains the same permittivity in between the terminals 21. Accordingly, it is possible to attain impedance matching easily for all of the terminals 21.

In the embodiment, the terminals 21 are divided into groups. Then each group of the terminals 21 are molded integrally with the base member 22, thereby making the blade 20 having a relatively small dimension in the terminal aligning direction. As a result, the mold for making the blade 20 is able to have relatively small dimensions. Consequently, the melting resin is filled up easily inside the mold, as well as between the terminals 21. Thus, it is possible to prevent the air gap from being formed between the terminals 21 more assuredly. Accordingly, it is possible to attain impedance matching more certainly.

When the blade is formed with the terminals aligned and the base member by molding integrally, it is not uncommon, in order to form the connecting portions, all of the end portions of the terminals protruding from the base member are bent after the terminals having a straight shape are molded integrally with the base member. When the connecting portion is formed, the terminals are bent at the same time with a tool, along a virtual line extending as long as all of the terminals are aligned in the terminal aligning direction. When the virtual line is inclined due to an error of positioning of the terminals or the tool and the like, each terminal is bent at a different point in the longitudinal direction thereof. In this case, positions of the connecting portions vary among the terminals, resulting an unstable connection since it becomes difficult to connect the connecting portions of all terminals steadily to the corresponding circuit portions of the circuit board.

If all terminals are molded integrally with the base member, the blade has the relatively large dimension in the terminal aligning direction. Accordingly, in the situation described above, the terminal at one end in the terminal aligning direction is bent at more distant point from a point the terminal at another end is bent in the longitudinal direction thereof. Consequently, the positions of the connecting portions between the terminals vary more significantly. As a result, the connection between the connecting portion and the corresponding circuit portion can be more unstable.

In the embodiment, the blade to be inserted to one connector is formed so as to divide in the width direction of the connector. Accordingly, the dimension of the blade in the terminal aligning direction becomes relatively smaller. When the connecting portion is formed in a state that the virtual line is inclined and the positions of the connecting portions vary among the terminals, the positions of the connecting portions between the terminals are less different in the longitudinal direction of the terminals since each of the blades has the relatively smaller dimension in the terminal aligning direction. As a result, the connection between the connecting portion and the corresponding circuit portion can be more stable.

Moreover, in the embodiment, a plurality of the blades having the relatively smaller dimension in the terminal aligning direction is used as a group. Accordingly, the same blades can be used for housings with various dimensions in the terminal aligning direction, by adjusting a number of the blades to be aligned in the terminal aligning direction. Consequently, it is not necessary to use a different mold or materials in order to form the blade. As a result, it is possible to keep a production cost for the connector low.

In the embodiment, the plurality of the blade 20 is inserted into the retaining portions 12A and 12B of the housing 10 from upper end side thereof, where the contact portion 12A-2 and 12B-2 are located. Accordingly, even if the housing 10 does not have a sufficiently accurate dimension in the longitudinal direction of the terminal 21 at different positions in the terminal aligning direction or the width direction of the connector due to a deformation thereof and the like, it is possible to uniform the positions of the connecting portions 21A-1 and 21B-1 of the terminal 21 in the longitudinal direction of the terminal 21, in a whole range of the terminal aligning direction, since an inserting amount of each of the blade 20 can be adjusted. As a result, the connection between all of the terminals 21 and the corresponding circuit portion on the circuit board can be more stable.

In the embodiment, as already described, the elongated protruding portion 11A of the housing 10 sandwiches and holds the blade 20 at positions the holding protruding portions 22C-1 and 22C-2 are situated as the blade 20 is inserted into the retaining portion 12 of the housing 10. In addition, except the above mentioned positions, the blade 20 does not contact with the retaining portion 12. Thus, the hollow portions are provided between the blade 20 and the retaining portion 12.

Accordingly, the blade 20 has a relatively small contacting area with the retaining portion 12 since only the holding protruding portions 22C-1 and 22C-2 sandwich and hold the blade 20 locally. Thus, even if an external force is applied unexpectedly to the connector 1 arranged on the circuit board, the external force is hardly transferred to the blade 20 since the contacting area of the blade 20, in other words, the stress-transferring area is relatively small. A stress originated at the external force is transferred from the housing 10 to the fixing member 30 for the most part. As a result, the stress is not transferred easily to connecting areas of the connecting portions 21A-1 and 21B-1 of the terminal 21 and the corresponding circuit portions of the circuit board, thereby maintaining the connection stable.

In the embodiment, the ground plate 23 made from metal is fixed to one of the plate surfaces of the base member 22 so as to cover a range the plurality of the terminals 21 is aligned. Further, the ground piece 23A formed on the ground plate 23 contacts elastically with the ground terminal 21. Accordingly, a transmitting performance can be improved compared to a case that the ground plate does not contact with the ground terminal.

In the embodiment, a ground portion is formed as the ground terminal 21B having the same shape with the signal terminal 21A. Generally, the terminals of the connector are soldered to the corresponding circuit portions on the circuit board by reflow soldering, that is, the connector and the circuit board have a solder paste in a state not melted yet therebetween, and are heated together in a heating device (not shown).

When the ground portion is formed integrally with the ground plate instead of the ground terminal, such as a leg portion extending from a lower end of the ground plate, a heat dissipation amount from a surface of the ground plate is much larger than a heat dissipation amount from a surface of the signal terminal at reflow soldering. That is because the ground plate formed together with the ground portion has a much larger surface area than the surface area of each terminal. In other words, heat may not be supplied sufficiently to a connecting area of the ground portion and the corresponding circuit portion as the heat dissipation from the surface of the ground plate becomes larger.

As a result, the connecting area may not be soldered sufficiently. On the other hand, the signal terminal can be soldered sufficiently since the heat can be supplied sufficiently to a connecting area of the signal terminal having a relatively smaller connecting surface area and the corresponding circuit portion. Consequently, the stability of the connection can vary widely between the signal terminal and the ground terminal.

In the embodiment, the ground terminal having the same shape with the signal terminal is provided. Accordingly, the heat is supplied sufficiently to the connecting area of the ground terminal and the corresponding circuit portion compared to the case that the ground portion is formed integrally with the ground plate, such as a leg portion extending from a lower end of the ground plate, since the ground terminal as the ground portion has a smaller surface area. As a result, the connecting area of the ground terminal and the corresponding circuit portion can be soldered sufficiently.

In addition, in the embodiment, the ground terminal has the equal surface area and equal heat dissipation amount with the signal terminal. Thus the heat supplied to the connecting area of the ground terminal and the corresponding circuit portion can be equal with the heat supplied to the connecting area of the signal terminal and the corresponding circuit portion. Consequently, the stability of the connection can be less variable between the signal terminal and the ground terminal.

In the embodiment, the housing is made from the synthetic resin but it is not limited to the synthetic resin. A material for the housing may be other electrical insulator. The material for the housing, for example, may be metal as well. When the housing is made from metal, the housing needs to be furnished at an area contacting with the terminal and the ground plate thereof with an electrical insulating layer. It is possible to improve ground effect of the connector with the housing made from metal.

In the embodiment, the blades are aligned in the form of two rows. In the present invention, a number of the rows is not limited to two. The blades may be aligned in a form of one row, or more than three rows.

In the embodiment, two circuit boards extending in parallel are connected to each other as the connector 1 is connected to the mating connector 2. The two circuit boards are not limited to be situated in parallel. For example, two circuit boards extending perpendicular to each other may be connected electrically with the mating connector having a triangle shape as the mating connector is connected to the connector.

In the embodiment, the plurality of the terminals is aligned with the equal intervals. It is not necessary the intervals to be equal between the terminals. For example, the intervals may be adjusted by bending the terminal in an approximate crank shape in order to attain impedance matching, according to a thickness dimension (a dimension in a direction facing to the blade) and a width dimension (a dimension in the terminal aligning direction) of the terminal. More specifically, the terminal needs to be bent so that the dimension of intervals is increased when the terminal has the large thickness dimension. When the terminal has the small width dimension, the terminal needs to be bent so that the dimension of intervals is decreased.

In the embodiment, the housing sandwiches and holds the blade at two positions in the longitudinal direction thereof, that is, the positions the holding protruding portions are situated in a holding groove. In the present invention, a number of the positions sandwiching and holding the blade is not limited to two. The blade may be sandwiched and held at one position, or at more than three positions.

The disclosure of Japanese Patent Application No. 2008-242879, filed on Sep. 22, 2008 is incorporated in the application by reference.

While the invention has been explained with reference to the specific embodiments of the invention, the explanation is illustrative and the invention is limited only by the appended claims.

What is claimed is:

1. An electrical connector for connecting a circuit board, comprising:

a plurality of blades, each of said blades including a holding groove substantially at a center portion thereof;

a plurality of terminals disposed on each of the blades and extending in parallel to each other; and a holding member for holding the blades next to each other to be situated on a same plane, said holding member including a protruding portion tightly fitted in the holding groove.

2. The connector device according to claim 1, wherein said holding member includes a retaining portion so that the blades are fitted in the retaining portion.

3. The connector device according to claim 1, wherein at least one of said holding member and each of said blades includes a holding protrusion for fixing the each of the blades.

4. The connector device according to claim 1, wherein said holding groove is arranged to extend over a length greater than half of the blade.

5. The connector device according to claim 1, wherein each of said blades includes a base member, said terminals being integrated with the base member.

6. The connector device according to claim 5, wherein each of said terminals includes a connection portion for connecting to the circuit board, said connection portion protruding from an edge portion of the base member.

7. The connector device according to claim 5, wherein each of said blades includes a ground plate attached to the base member for covering the terminals.

8. The connector device according to claim 1, wherein said holding groove includes an upper opening portion and a lower opening portion so that the protruding portion can be inserted through one of the upper opening portion and the lower opening portion.

9. The connector device according to claim 8, wherein each of said blades includes a holding protrusion for firmly holding the protruding portion in the holding groove near at least one of the upper opening portion and the lower opening portion.

* * * * *